US005987668A

United States Patent [19]

Ackley

[11] Patent Number: 5,987,668

[45] Date of Patent: Nov. 23, 1999

[54] FABRIC COVERED MATTRESS PAD

[75] Inventor: Robert E. Ackley, Greenville, S.C.

[73] Assignee: Span-America Medical Systems, Inc., Greenville, S.C.

[21] Appl. No.: 08/929,560

[22] Filed: Sep. 15, 1997

[51] Int. Cl.[6] ..... A47C 27/14; A47G 9/00

[52] U.S. Cl. ..... 5/500; 5/691; 5/737; 5/925; 5/420; 428/159; 442/221; 442/223; 442/370; 442/372

[58] Field of Search ..... 5/420, 690, 691, 5/731, 737, 925, 500, 502; 442/221, 223, 370, 372; 428/159

[56] References Cited

U.S. PATENT DOCUMENTS

| | | | |
|---|---|---|---|
| D. 362,578 | 9/1995 | Ackley | D6/601 |
| 2,648,618 | 8/1953 | Alderfer | 428/138 |
| 2,957,793 | 10/1960 | Dickey | 442/221 |
| 3,016,317 | 1/1962 | Brunner | 5/420 |
| 3,028,279 | 4/1962 | Heberlein | 442/221 |
| 3,256,131 | 6/1966 | Koch et al. | 442/221 |
| 4,147,828 | 4/1979 | Heckel et al. | 5/420 |
| 4,686,725 | 8/1987 | Mitchell | 5/691 |
| 5,010,610 | 4/1991 | Ackley | 5/420 |
| 5,281,000 | 1/1994 | Ackley | 297/397 |
| 5,360,653 | 11/1994 | Ackley | 428/159 |
| 5,645,914 | 7/1997 | Horowitz | 5/420 |

FOREIGN PATENT DOCUMENTS 2244000A 11/1991 United Kingdom .

*Primary Examiner*—Alexander Grosz
*Attorney, Agent, or Firm*—Dority & Manning, PA

[57] ABSTRACT

A washable fabric covered mattress pad involves the combination of a layer of resilient foam with a layer of fabric, both of which layers are machine washable and dryable. The fabric, either manmade or natural fiber material, is flame laminated to one side of the layer of foam. The non-covered side of the foam layer frictionally engages a mattress for non-slip self-positioning of the mattress pad without requiring straps or other specific holding mechanisms. A second or additional layers of foam of varying physical characteristics and/or thicknesses may be added through heat bonding thereof in a predetermined pattern to the non-covered side of the first layer of foam. Such arrangement results in a fabric covered, completely washable self-positioning mattress pad, such as having a preferred thickness generally in a range of from about one to about four inches.

17 Claims, 6 Drawing Sheets

FABRIC COVERED MATTRESS PAD

BACKGROUND OF THE INVENTION

The present invention relates in general to improved consumer comfort products, and more particularly to an improved fabric covered mattress pad which is both washable and non-slip.

A considerable number of products have been marketed for some time in the nature of mattress pads, overlays, or some sort of device a user can add to the upper support surface of an existing mattress. Other uses of such types of products may involve their placement directly on a floor, such as beneath a temporary air mattress or a sleeping bag, rather than directly on a regular bed mattress.

A number of such designs involve various pads or overlays formed at least in part from foam materials, such as resilient polyurethane foam. Such foam pieces may have various surface shapes for user comfort, including, for example, such as a convoluted upper surface. U.S. Pat. No. 4,686,725 entitled "Mattress Cushion with Securement Feature" and commonly assigned with the subject application, is an example of a resilient foam mattress supplement or pad with a convoluted support surface on one side thereof, and with no covering.

A significant aspect of consumer goods, especially articles used on a bed, is whether it is practical to periodically wash such goods, and the ease with which washing is accomplished. Mattress pads of unfinished foam (i.e., plain foam pads without any sort of covering) are generally not well suited for routine washing. Specifically, plain foam typically lacks adequate tensile strength to withstand washing. In other words, resilient foam acts very much like a sponge, which absorbs tremendous amounts of water having relatively great weight. Under such circumstances, unfinished foam is highly subject to becoming torn or otherwise damaged during a wash cycle or subsequent handling.

Other approaches to providing a washable product involving foam (or other filled tickings) is to have a sewn product made with a traditional "quilting" machine which sews through the filler and the covering. For example, U.S. Pat. No. 5,010,610 entitled "Multi Layer Supplemental Support Pad" and commonly assigned with the subject application, shows a layer of foam surrounded by fabric material, all held together with stitching.

One drawback to such arrangements generally is that the above-referenced conventional quilting machine has an opening which can only handle a limited thickness of collective materials, such as only one-half to three-quarters of an inch thick. Such limitation makes it impractical to use such technology to create a mattress pad of adequate thickness for relatively firm support while still producing a washable product.

In another aspect of U.S. Pat. No. 5,010,610, various straps are provide to aid securing of the product during use, in particular, involving, for example, a chaise lounge chair.

Yet another approach in the marketplace to providing a covered mattress pad involves providing a pad with a completely removable (for example, zippered) fabric cover. Typical such arrangements may involve a foam base pad or polyester filling, with a fabric cover having a peripheral zipper which exposes one or more edges of the interior base pad, for selected removal and reentry thereof.

Various drawbacks exist with approaches involving the removal of an exterior cover from a base pad. For example, only the cover itself is washable in those circumstances, for generally the same reasons that an unfinished foam piece is unwashable. Another negative aspect is simply the fact of having to remove and subsequently reposition the cover in order to conduct even such partial washing of the product. Such removal and reentry operations are often difficult and/or relatively time consuming to realign the base as desired within the cover. Still a further drawback is that many such arrangements require or make use of straps or similar means to hold the product in place on the mattress. Such are needed because the cover material is often relatively slick, thereby reducing frictional engagement and preventing self-positioning or non-slip functioning of the product.

Other examples of various support supplements are shown by U.S. Pat. No. 5,281,000 and U.S. Design Pat. No. D362,578, both of which are commonly assigned with the subject application.

SUMMARY OF THE INVENTION

The present invention recognizes and addresses various of the foregoing problems, and others, concerning mattress pads. Thus, broadly speaking, a principal object of this invention is providing improved mattress pads. More particularly, a main concern is providing improved fabric covered mattress pads, primarily adapted for consumer use.

It is therefore another particular object of the present invention to provide an improved fabric covered mattress pad which is practical for periodic washing (and/or drying), without requiring any disassembly and reassembly thereof, and without requiring any special or advance preparation for such washing (and/or drying) operations.

It is another general object of the present invention to provide such an improved washable fabric covered mattress pad which is self-positioning in the sense that it helps to avoid slippage during use, such as resting on a mattress. A more particular object is to provide such an improved non-slip washable fabric covered mattress pad which obviates the need for straps or other similar mechanisms to aid in holding the pad in place.

Another present general object is to provide an improved fabric covered mattress pad with the above advantageous features, which also may be modified with various predetermined patterns (i.e., support shapes in the pad) for improved comfort and/or for improved aesthetics. Another particular object is to provide various predetermined patterns in different alternate mattress pad embodiments, which patterns are preselected so as to fit into the sized scheme of a particular mattress pad while increasing both the support comfort and the feel comfort to the user consumer.

It is to be understood that a machine washable mattress pad provided in accordance with this invention is also machine dryable, and references herein to washing are intended to likewise encompass such drying operations.

Provision of various washable fabric covered mattress pads of different thicknesses and/or different sizes for use with different sized beds and support arrangements is yet another present objective.

Additional objects and advantages of the invention are set forth in, or will be apparent to those of ordinary skill in the art from, the detailed description herein. Also, it should be further appreciated that modifications and variations to the specifically illustrated and discussed features and steps or materials and devices hereof may be practiced in various embodiments and uses of this invention without departing from the spirit and scope thereof, by virtue of present reference thereto. Such variations may include, but are not limited to, substitution of equivalent means and features, materials, or steps for those shown or discussed, and the functional or positional reversal of various parts, features, steps, or the like.

Still further, it is to be understood that different embodiments, as well as different presently preferred embodiments, of this invention may include various combinations or configurations of presently disclosed features, elements, or steps, or their equivalents (including combinations of features or steps or configurations thereof not expressly shown in the figures or stated in the detailed description).

One exemplary embodiment of the present invention relates to an improved washable fabric covered mattress pad. Such pad comprises preferably a first layer of machine washable foam having opposing generally planar sides, such first layer of foam having predetermined length, width, and thickness dimensions selected for use as a mattress pad. Such pad preferably further includes a layer of machine washable fabric having length and width dimensions corresponding with those of the first layer of foam, with such layer of fabric being non-removably secured with one generally planar side of the first layer of foam so as to leave the other planar side thereof without fabric adhered thereto.

In certain additional embodiments, such washable fabric covered mattress pad may further include a second layer of machine washable foam having opposing generally planar sides, and bonded on one side thereof in a predetermined pattern to the other planar side of the first layer of foam, so as to leave one side of the second layer of foam exposed for non-slip frictional engagement thereof with a mattress on which the mattress pad is used.

Yet another construction comprising a present exemplary embodiment includes a fabric covered, completely washable self-positioning mattress pad. Such mattress pad embodiment preferably includes first and second layers of resilient foam material and a layer of fabric.

In the foregoing exemplary embodiment, the first layer of resilient foam material preferably has respective upper and lower support surfaces. The layer of fabric is permanently bonded to the upper support surface of such first layer of foam. The second layer of resilient foam material likewise preferably has respective upper and lower support surfaces. The upper support surface of such second layer of resilient foam material is preferably permanently bonded in a predetermined pattern to the lower support surface of the first layer of resilient foam. Such bonding arrangement forms the predetermined pattern therein while leaving the lower support surface of the second layer of resilient foam exposed for frictional self-positioning non-slip engagement thereof with a mattress on which the mattress pad is used.

In further exemplary embodiments, any of the above-referenced exemplary improved fabric covered mattress pads may utilize at least two respective sublayers of foam for the above-referenced first layer of foam. Such sublayers may have preselected characteristics and be bonded to one another. The preselected characteristics may involve improved respective characteristics for bonding to the layer of fabric and for bonding to the other sublayer of foam and providing enhanced user support.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the specification, which makes reference to the appended figures in which.

Figure 1:
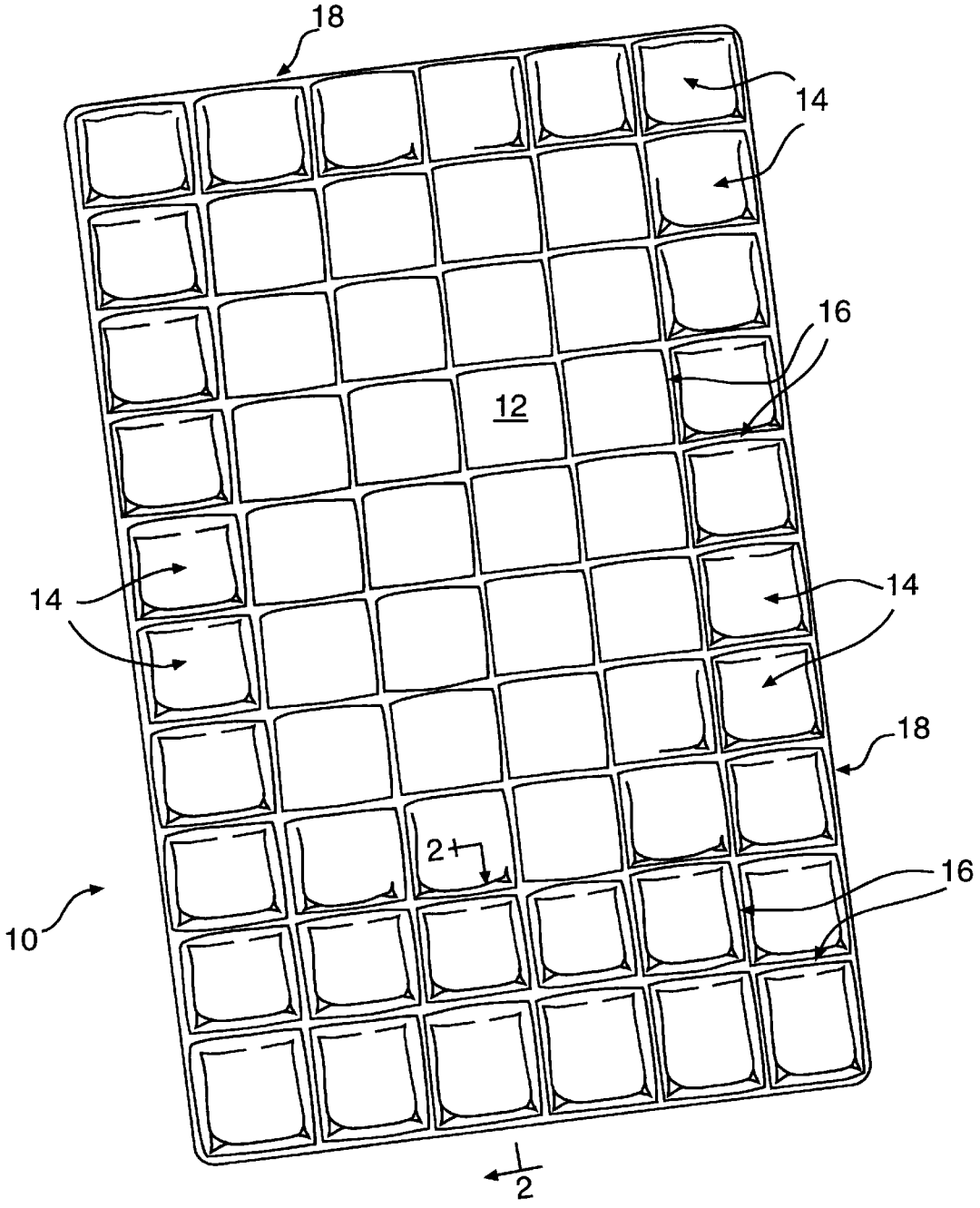
FIG. 1 is a generally top elevational view with slight perspective view, of a first embodiment of an exemplary fabric covered mattress pad in accordance with the subject invention.

Repeat use of reference characters throughout the present specification and appended drawings is intended to represent same or analogous features, elements, or steps of the invention.

DETAILED DESCRIPTION OF THE PREFERRED EMBODIMENTS

FIG. 1 illustrates a generally top elevational view, with slight perspective view, of a first exemplary embodiment of a fabric covered mattress pad generally 10 in accordance with the subject invention. It is to be understood that the following discussion relates to specifics of such exemplary embodiment, and others, and that such description and illustration do not limit the use of other embodiments in accordance with this invention.

While mattress pad 10 includes a plurality of layers in accordance with the subject invention, the upper layer thereof as intended to be turned for receiving a user thereon is comprised of fabric material generally 12. Mattress pad 10 has a predetermined pattern formed in the pad and therefore visible at the upper surface of fabric material 12. While such predetermined pattern may comprise various preselected shapes, the exemplary preferred mattress pad embodiment 10 is shown with a preselected number of rectangles generally 14 formed over mattress pad 10. With such an arrangement, mattress pad 10 has a quilted appearance.

As will be discussed in greater detail below, such predetermined pattern is preferably formed by a plurality of predetermined heat bonding lines generally 16, which are also used to bond several different layers of foam together, in accordance with this invention. Equivalent bonding techniques may be utilized, so long as a bonded relationship exists between the several layers of foam, forming the desired predetermined pattern.

As illustrated per FIG. 1, a peripheral edge 18 may likewise be formed around mattress pad 10, so as to complete those rectangles 14 which are otherwise formed adjacent such edge. Edge 18 also provides a finished appearance and otherwise completed structure to mattress pad 10.

Figure 2:
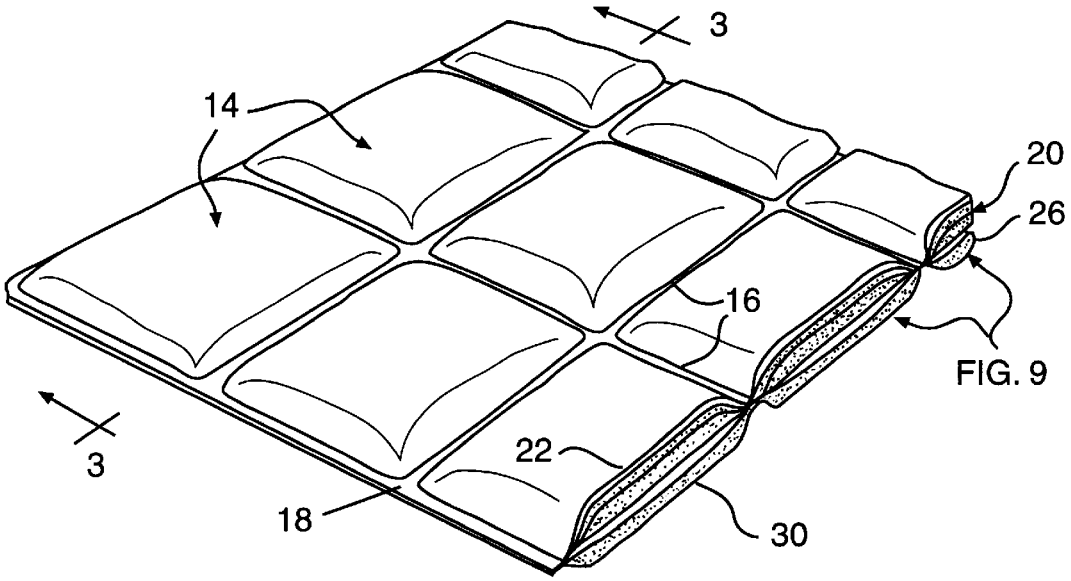
FIG. 2 is an enlarged sectional view of part of the FIG. 1 embodiment, taken along section line 2—2 as shown in FIG. 1, and illustrating a generally top perspective view of such exemplary fabric covered mattress pad.
Figure 3:
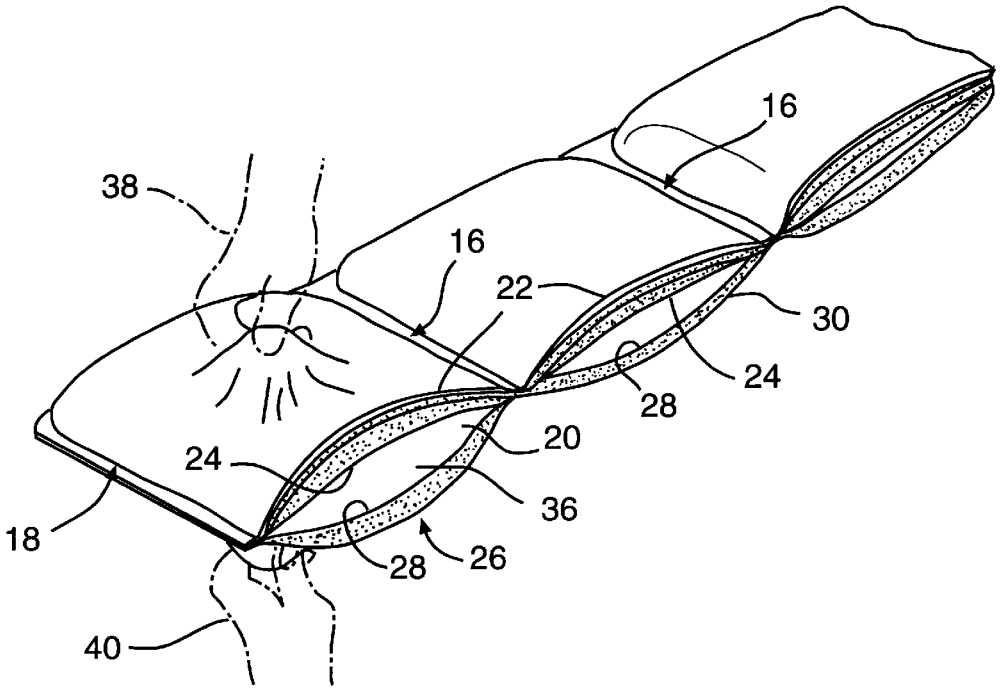
FIG. 3 is a further enlarged sectional view of the present subject matter of FIG. 2, taken along the sectional line 3—3 indicated in such FIG. 2.
Figure 9:
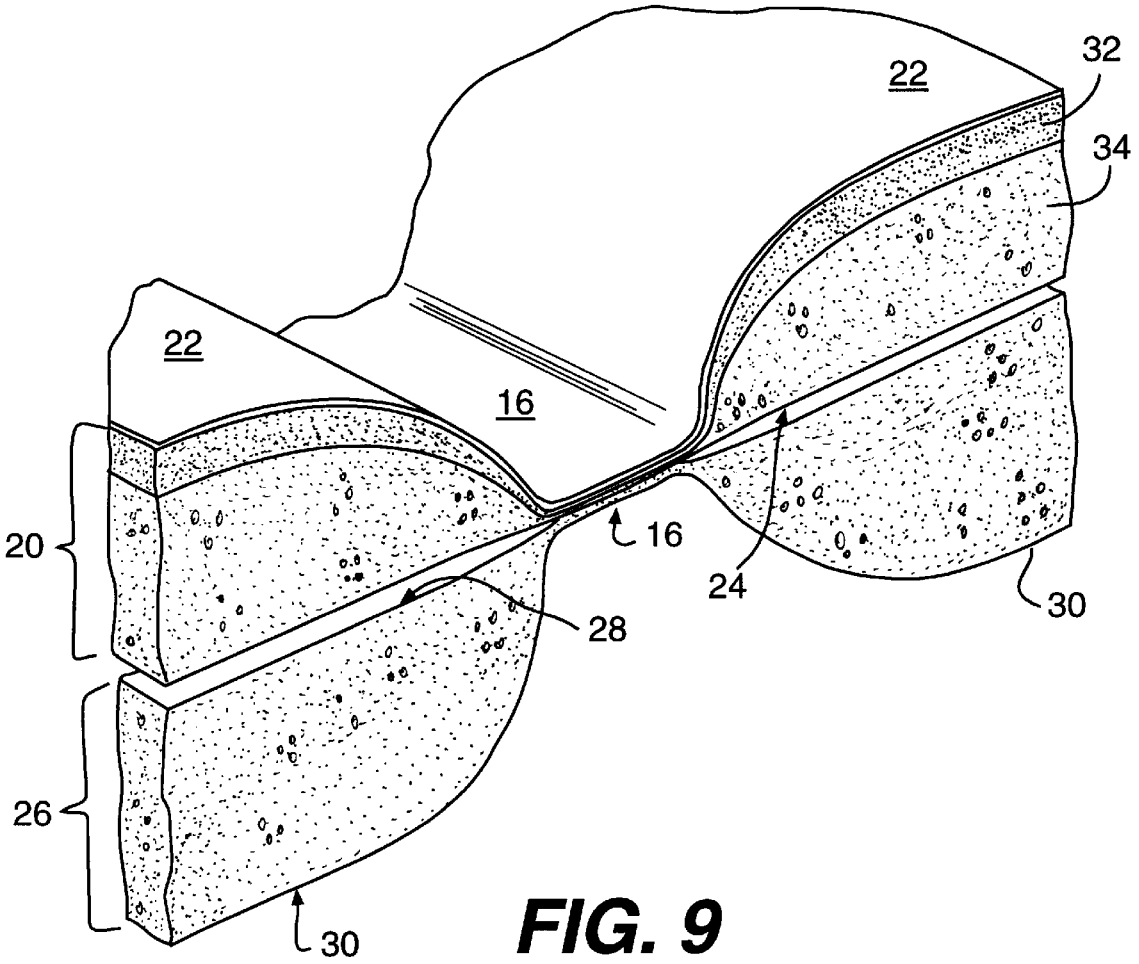
FIG. 9 is a greatly enlarged view of a portion of the FIG. 2 cross-sectional view of an exemplary fabric covered mattress pad in accordance with the subject invention, to better show additional detail relating to various layers of such exemplary embodiment.

Additional details regarding the structure of exemplary mattress pad 10 are discussed in greater detail hereinafter with reference to FIGS. 2, 3, and 9. Such figures are progressively enlarged cross-sectional views of a portion of exemplary mattress pad 10. Specifically, FIG. 2 is an enlarged cross-sectional view taken along the section line 2—2 as illustrated in present FIG. 1. Such FIG. 2 represents a plurality of adjoining rectangles 14 of such exemplary embodiment and the cross-sectional aspect thereof begins to show additional details of such embodiment. FIG. 3 shows even greater enlarged detail with reference to three of such rectangles 14 along the section line 3—3 as indicated in FIG. 2. FIG. 9 shows the greatest degree of detail by representing an enlarged partial view of adjoining features between two adjacent rectangles 14, in the exemplary portion of FIG. 2 indicated therein.

Collectively, FIGS. 2, 3, and 9 illustrate a washable fabric covered mattress pad generally 10 in accordance with this invention, having a plurality of layers. A first layer of machine washable foam generally 20 has opposing generally planar sides. Such first layer 20 has a predetermined length, width, and thickness dimensions selected for use as a mattress pad.

Non-removably secured to such layer 20 in accordance with the subject invention is a layer of machine washable fabric generally 22. As represented, such fabric layer 22 preferably has length and width dimensions corresponding with those of the first layer of foam 20. Further in accordance with this invention, fabric layer 22 is non-removably secured on one generally planar side of first foam layer 20 so as to leave the other planar side generally 24 thereof without any fabric adhered thereto.

As further represented in present FIGS. 2, 3, and 9, a second layer of machine washable foam generally 26 may be provided, also having opposing generally planar sides. Such upper side generally 28 of second layer 26 is preferably bonded or secured in a predetermined pattern to the lower side 24 of first layer 20. At the same time, lower side 30 of the second layer 26 is left exposed for non-slip frictional engagement thereof with a mattress on which mattress pad 10 is used.

Since layer 26 of machine washable foam preferably comprises resilient polyurethane foam, an exposed surface 30 of such material will provide frictional self-positioning non-slip engagement with a mattress or other surface on which it is received. Such arrangement advantageously enables the invention of exemplary mattress pad 10 to avoid the need for any straps or other mechanisms for aiding securement of the mattress pad to the desired location. Instead, in accordance with the subject invention, mattress pad 10 may simply be placed initially in the desired location, to remain there until repositioned by the user.

FIG. 9 best illustrates a further, optional feature of the subject invention, in that the first layer of foam generally 20 may be comprised of at least two respective sublayers of foam 32 and 34 which are bonded to one another. In accordance with the subject invention, the advantage of such an arrangement is that it permits control of product characteristics and performance, as well as controlling manufacturing cost aspects of the invention.

For example, sublayer 32 may be selected of foam characteristics particularly suited and well adapted for bonding to the layer of fabric material 22, such as with flame lamination techniques. At the same time, sublayer 34 may be selected for characteristics better suited to resilient user support. It is well understood by those of ordinary skill in the art that various known adhesive materials or other techniques may be used to non-removably bond sublayers 32 and 34 with one another, all of which variations are intended to come within the spirit and scope of the present invention. Also, more than two sublayers may be practiced within a given layer of foam. Sublayers may also be used in layer 26. Also, different lateral sections of foam may be sandwiched into or between certain sublayer arrangements, as desired.

FIG. 3 better illustrates another aspect of the subject invention, in that formation of a predetermined pattern of preselected geometric shapes, such as rectangles, forms pockets generally 36 for air between opposing layers of foam collectively defining individual of such shapes. A pair of hands 38 and 40 are shown in phantom in FIG. 3, to illustrate the ease with which the respective layers 20 and 26 of foam may be pulled apart from one another in the areas other than along bonding lines 16 or peripheral edge 18.

It is to be understood that pockets 36 for air are not meant in the context of the subject invention to mean that such pocket is air tight. Instead, it represents an area or pocket for air to beneficially move in relation to a user supported thereabove, such as for beneficial cooling effects. In such context, it is understood that all of the multiple layers of present FIGS. 2, 3, and 9 are generally air permeable, meaning that both the fabric and the open-celled structure of the various foam layers beneficially transmit air to permit cooling, drying, and other beneficial effects with a user supported thereon.

Figure 4:
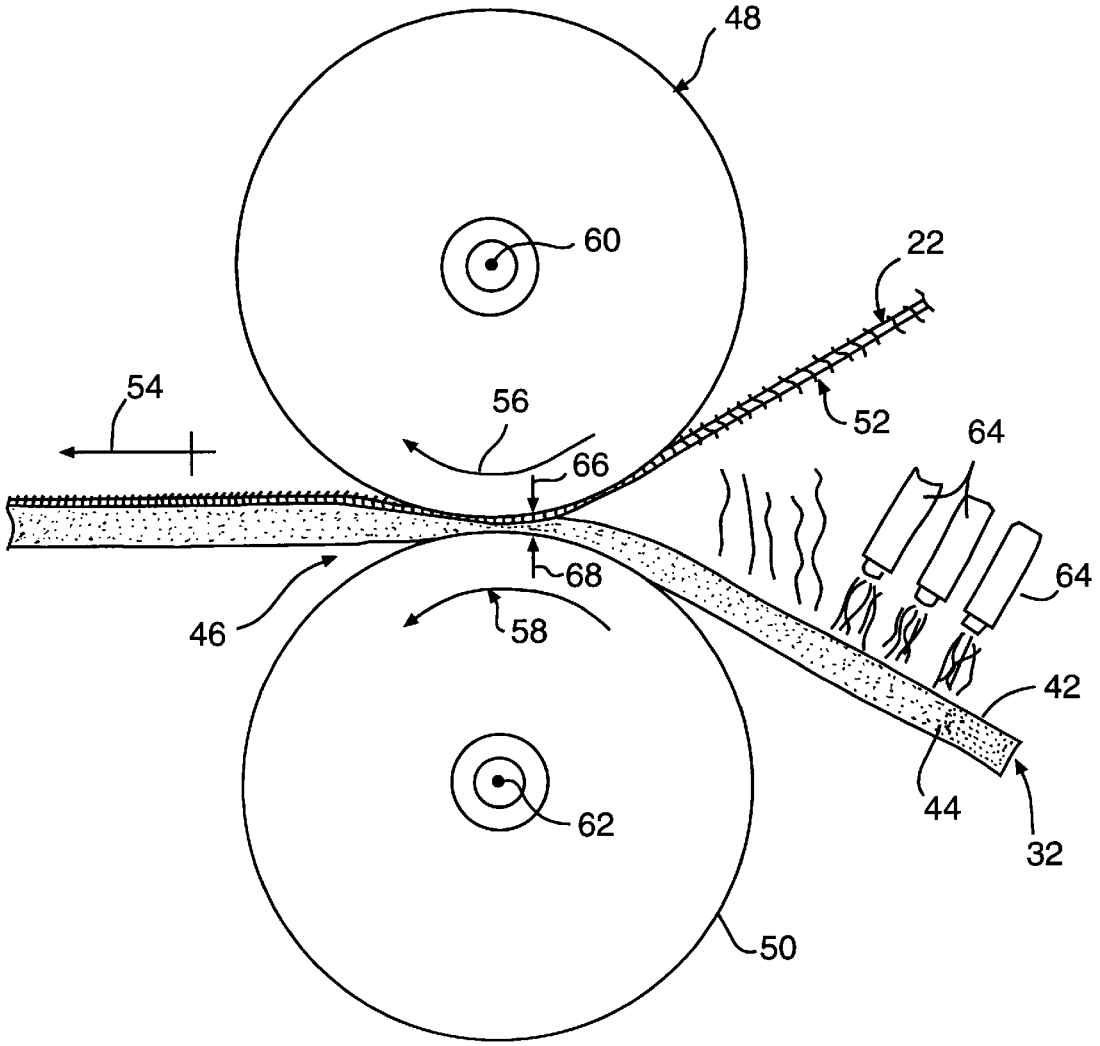
FIG. 4 is a side plan and partially diagrammatical view of a portion of manufacturing operations involved with making per one exemplary approach an exemplary embodiment of the present fabric covered mattress pad invention.
Figure 5:
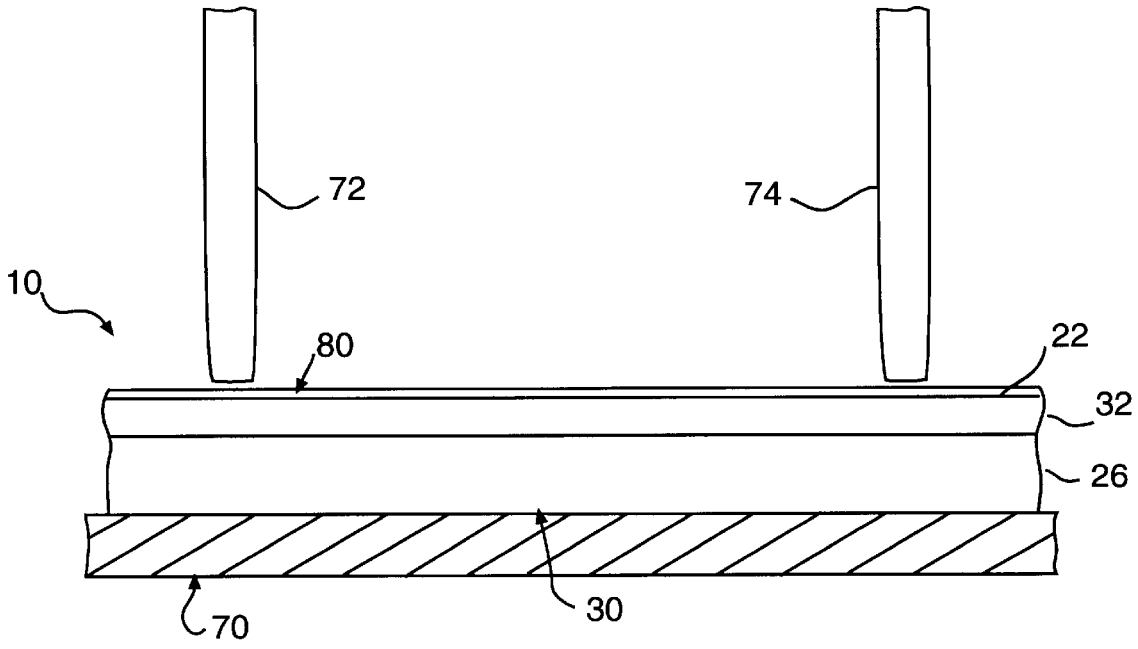
FIGS. 5 and 6 are sequential side cross-sectional and partial diagrammatical views of further exemplary manufacturing steps practiced in accordance with the subject invention for making exemplary embodiments of the subject fabric covered mattress pad.
Figure 6:
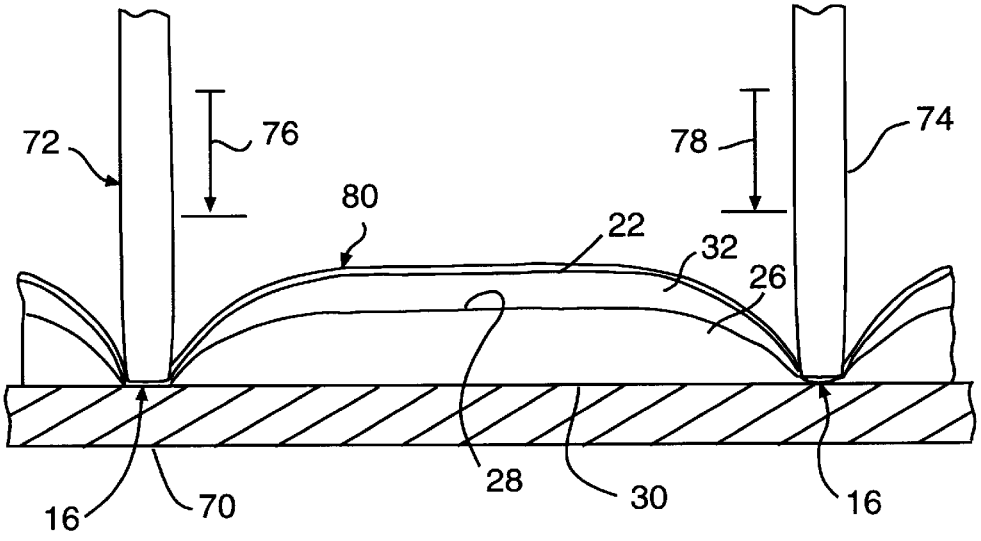

FIGS. 4, 5, and 6 represent additional aspects regarding the subject invention, including disclosure regarding making various exemplary embodiments thereof.

More particularly, FIG. 4 illustrates a generally side plan view (and partial diagrammatical view) of certain aspects of manufacturing operations, while FIGS. 5 and 6 illustrate progressive or sequential side views of further manufacturing steps pertaining to other aspects.

Broadly speaking, the subject invention involves, in part, permanently bonding a layer of fabric 22 with one side of a layer of foam. FIG. 4 represents use of sublayer 32 of foam layer 20. However, it is to be understood that such sublayer is representative generally of layer 20 of foam, such that additional sublayers may be already secured thereto for passing between the nip point generally 46 formed between two opposing rollers 48 and 50.

As illustrated, sublayer 32 has respective upper and lower generally planar sides 42 and 44. Upper side 42 of sublayer 32 is presented to a lower side generally 52 of fabric layer 22.

As well understood by those of ordinary skill in the art from the illustration and discussion herewith, fabric layer 22 and foam sublayer 32 are propelled together through nip area 46 generally in the direction of arrow 54 by the rotation of rollers 48 and 50 respectively in the directions of arrows 56 and 58 about their respective axes of rotation 60 and 62. Driving techniques and control of such rollers 48 and 50 will be understood by those of ordinary skill in the art without additional details thereof.

As further illustrated by present FIG. 4, heating elements or means generally 64 may be provided for heating upper surface 42 of foam sublayer 32. In such heated condition, nip point 46 (through rollers 48 and 50) applies compressive forces, generally in the directions of opposing arrows 66 and 68, to press lower side 52 of fabric layer 22 into the heated upper surface 42 of foam sublayer 32. The resulting process is referred to as flame lamination, wherein the upper surface 42 of foam sublayer 32 is heated to a melting point, so as to become a type of adhesive so as to permanently bond with, and be non-removably secured to, the fabric layer 22.

Those of ordinary skill in the art will understand that various different foam materials will have different particular temperatures to which they should be heated for achieving such flame lamination process, particulars of which form no specific aspect of the subject invention, and are not discussed herein in greater detail. Likewise, the amount of compressive force used and the speed of operation in the direction of arrow 54 are all factors which those of ordinary skill in the art may vary as desired or needed for working with particular materials and/or thicknesses thereof, without additional discussion herein.

It is to be further understood that alternate techniques for securing fabric layer 22 with foam sublayer 32 may be practiced in accordance with the subject invention, and will vary depending on the specific materials utilized. For example, fabric layer 22 may comprise one of either man-made or natural fiber materials, or blends thereof. In one preferred embodiment, such fabric layer comprises a nylon material flame laminated (i.e., heat bonded) to sublayer 32 of foam (or to a first layer of foam). Other materials may be practiced, for example, such as polyester or terrycloth materials or blends thereof, so long as they are permanently bonding with (i.e., non-removably secured to) the subject layer of foam. Also, in accordance with the subject invention, such fabric layers should be machine washable.

FIGS. 5 and 6 illustrate the sequence of a manufacturing step involving introducing a predetermined pattern into an exemplary mattress pad 10. For present purposes, a portion only of such a pad 10 is shown in cross-sectional view, illustrating a fabric layer 22 bonded with an exemplary foam sublayer 32. Separate therefrom (i.e., not bonded) is an exemplary second foam layer 26.

In an exemplary heated die/plate arrangement, well known to those of ordinary skill in the art, a heated plate generally 70 is provided to support the lower surface 30 of second foam layer 26. Opposite heated plate 70 are a pair of exemplary heated die elements 72 and 74. It is to be understood by those of ordinary skill in the art that such die members are to be disposed in alignment with the predetermined pattern selected for a given embodiment of exemplary mattress pad 10. As is well understood, such die member 72 and 74 are also preferably heated.

FIG. 6 illustrates a subsequent sequence, wherein die members 72 and 74 are lowered in the directions of respective arrows 76 and 78 for contact with an upper side 80 of fabric layer 22.

As represented by present FIG. 6, the combination of die members 72 and 74 in cooperation with plate 70 not only apply heat to both sides of the combined layers 22, 32, and 26, but also provides compression. The amount of compression may be varied, as understood by those of ordinary skill in the art, as needed or desired for working with various materials and/or thicknesses thereof.

As a result of the FIG. 6 step, there is heat transfer between the respective heated elements so as to form the heat bonding lines 16, as otherwise discussed above with reference to FIGS. 2, 3, and 9. By changing the pattern of die elements 72 and 74, the corresponding predetermined pattern as formed by bonding lines 16 in exemplary mattress pad 10 is also changed.

It will be further apparent to those of ordinary skill in the art from the disclosure herewith that second foam layer 26 and exemplary sublayer 32 are only bonded to each other along the bonding lines 16 formed by the respective interactions of die member 72 with heated plate 70 and die member 74 with heated plate 70. A number of additional die members would be used in a typical die press arrangement practiced in accordance with this invention. The upper surface generally 28 of second foam layer 26 is otherwise free from exemplary foam sublayer 32. In other words, after die members 72 and 74 (and others) are raised in the directions opposite to respective arrow 76 and 78, the structure represented by present FIGS. 2, 3, and 9 is in place, which would permit foam layers 32 and 26 to be drawn back from one another (as represented in present FIG. 3 with reference to pockets 36), only limited by the existence of bonding lines 16 (which lines are also generally represented in present FIG. 6).

Those of ordinary skill in the art will understand that various dwell times for compressing die members against the plate, and variations in the respective temperatures of such elements, may be practiced as different foam materials and/or fabric materials and thicknesses thereof are utilized. In such context, it would be understood that certain materials (for example, such as nylon) work better for heat bonding with relatively lower temperature settings (for example, about 200° F.) in view of their relative heat sensitivity, while certain foam materials may tolerate and need relatively higher temperatures (such as about 350° F.) to obtain desired relatively permanent bonding.

Likewise, as temperatures are varied, dwell times may vary (for example, such as from 30 seconds to 60 seconds or other times) depending on various factors, as well understood by those of ordinary skill in the art without additional detail herewith. Precise compression force amounts, dwell times, and temperatures for particular materials and/or thicknesses thereof as required by the characteristics of such materials form no particular part of the subject invention, and therefore are not discussed in greater detail herewith.

It is to be further understood that the above-referenced die/plate process may be adapted and used in a die cut process to form the perimeter edge 18 of an exemplary mattress pad 10. With such an approach, both the predetermined pattern of a mattress pad and the peripheral edge thereof may be formed in a single step represented by the sequence of present FIGS. 5 and 6.

It is to be further understood that embodiments of the subject invention may utilize different foam materials and different layers of foam in different thicknesses. For example, first foam layer generally 20 may be comprised of a bonding sublayer 32 approximately one-quarter inch of an thick attached via adhesive or similar to a base sublayer 34 of foam about one inch thick. Then, for example, a similar thickness or thickness in a range of from about one inch to about one and one-half inches may be used for an accompanying second layer 26 of foam. Such an arrangement is one example of a structure adequately thick in accordance with the subject invention for providing firm support, while still providing a machine washable product without requiring the removal or replacement of any elements or features thereof for such machine washing.

Still further variations may be practiced, for example, covering collective thicknesses generally in a range of from about one inch to about four inches thick. Likewise, the width of the welds or heat bonding lines 16 may be varied, such as about one-eight or one-quarter of an inch wide. The thickness and width of the peripheral edge 18 may also be similarly varied.

Yet another variation which might be practiced in some alternative embodiments is for one or more of the foam layers, especially one of the upper layers of foam, to have an incorporated pattern of its own formed in its generally planar surface. For example, a convoluted surface, such as represented by above-referenced U.S. Pat. No. 4,686,725 could be practiced. All such variations are intended to come within the spirit and scope of the subject invention.

Another present aspect of the subject invention is that different embodiments may be made with different techniques. Generally, in the flame lamination technique referenced above, flame bonding is used to laminate the fabric layer to a first relatively higher grade (i.e., relatively more expensive) grade of foam. For such reason, a relatively thinner layer of such foam, such as about one-eighth or one-quarter of an inch may be preferred, and then the separate steps are used to adhere such sublayer to one or more further sublayers for forming first layer 20, with additional steps taken for alternatively securing such first layer 20 to a second layer 26 of foam. In other alternative structures comprising mattress pads in accordance with the subject invention, a single layer or piece of foam may be utilized for first layer 20, and a bonding layer of adhesive (i.e., film adhesives) utilized or situated between a fabric layer and the upper surface of such single piece of foam.

In still another alternative approach, a single stack of multiple layers might be formed through a single pass of a machine, involving an upper fabric layer situated on top of an adhesive layer situated on top of a specialized foam layer for heat bonding, further on top of an additional foam layer for more resilient user support.

Yet another aspect of the subject invention involves varying the predetermined pattern. For example, varying just the spacing between exemplary die members 72 and 74 creates the potential for affecting density and/or appearance of pad thickness by changing the relative compression of the individual elements 14. In other words, the actual compression and overall thickness of mattress pad 10 is determined somewhat by the degree to which respective foam layers 20 and 26 are drawn to one another. A factor in such characteristic is the interplay between the portions being drawn together by the bonding lines 16. Hence, variation on the lateral separation of exemplary die members 72 and 74 directly affects such compression aspects.

Still further, certain variations may involve the precise patterns created. For example, the exemplary rectangles 14 may be provided as squares, such as six inches square on either side, or as rectangles in a quilted pattern of seven inches by eight inches. So long as the die welds or heat bonding lines 16 are what hold respective foam layers 20 and 26 together, a virtual endless variety of predetermined patterns may be practiced in accordance with the invention. Within such context, different patterns may also be provided over different sections of a mattress pad, instead of having one uniform pattern over the entire surface of such mattress pad. Such variations in the predetermined pattern may then result in sectionalized support for a user. All such variations are intended to come within the spirit and scope of the subject invention.

Figure 7:
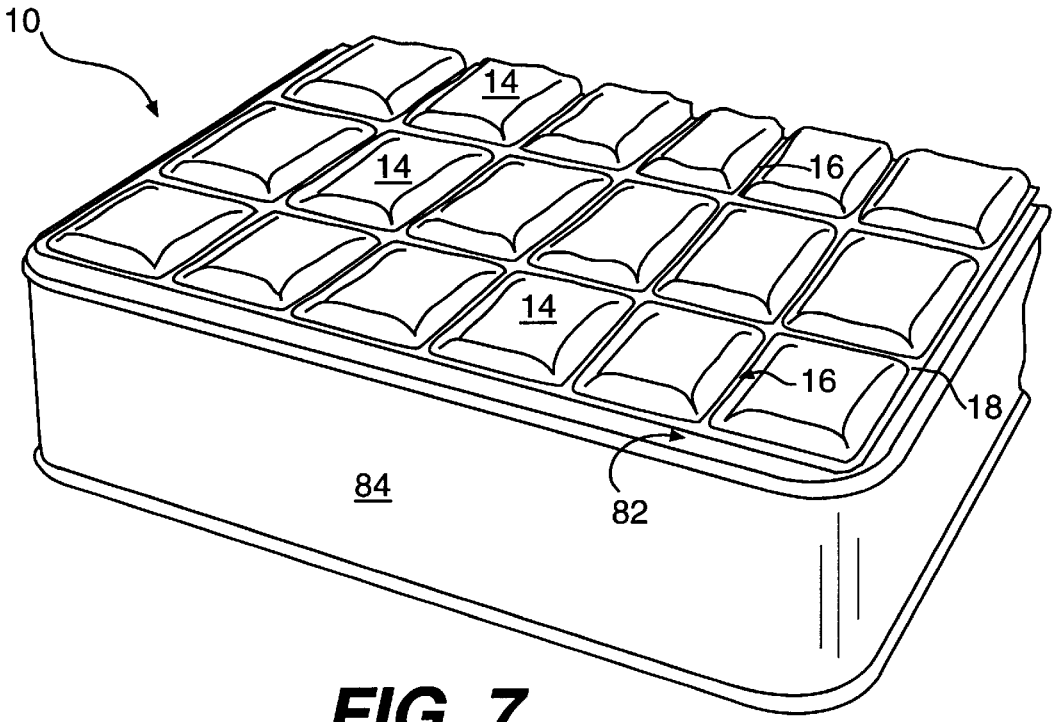
FIG. 7 is a partial view of a generally top and end perspective view of the first exemplary embodiment of the subject invention during use thereof on a mattress.
Figure 8:
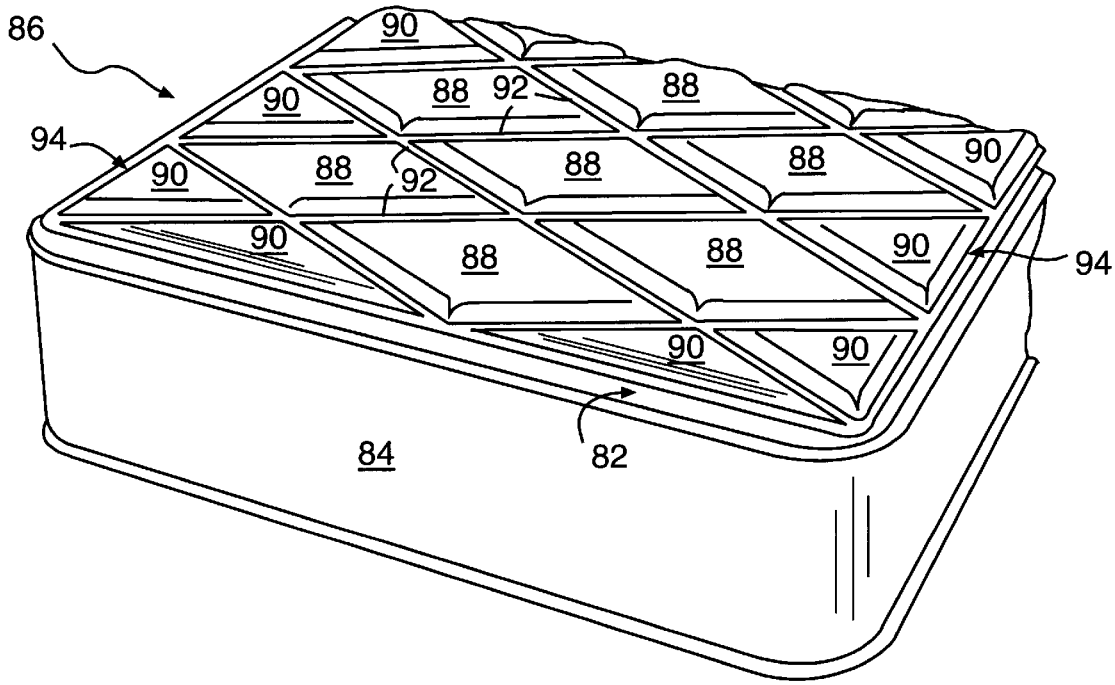
FIG. 8 is a partial view of a generally top and end perspective view of an alternative exemplary embodiment of the subject invention during use thereof on a mattress.

FIGS. 7 and 8 further represent exemplary variations in predetermined patterns incorporated into exemplary mattress pads.

More particularly, FIG. 7 shows a portion of a top, generally end perspective view of an exemplary mattress pad generally 10 in accordance with the subject invention, during use thereof. Such pad is supported on the upper surface generally 82 of an exemplary conventional mattress 84. It is to be understood that embodiments of the present invention may be utilized in other settings, such as directly on a floor, such as beneath an air mattress, sleeping bag, or similar.

As represented in present FIG. 7, preferably mattress pad 10 is sized to fit upper surface 82 of mattress 84, regardless of whether such mattress is a twin, full, queen, king, or other size mattress. For example, some exemplary sizes may be 54 inches by 75 inches and 57 inches by 79 inches. With the arrangement illustrated in present FIG. 7, the relative frictional self-positioning non-slip engagement of the underside of mattress pad 10 (i.e., lower surface 30 of second foam layer 26), means that no straps or other securement aids are needed in order to maintain the indicated position of mattress pad 10 on mattress 84.

FIG. 8 illustrates an exemplary embodiment of an alternative mattress pad 86 in accordance with the subject invention resting on an upper surface 82 of mattress 84. As represented by such top relatively end perspective view, the illustrated portion of such mattress pad 86 has a predetermined pattern formed of a plurality of preselected geometric shapes. In this instance, a plurality of exemplary diamonds generally 88 and truncated diamonds (i.e., triangles) 90 of various shapes and sizes are formed in mattress pad 86. It is to be understood that instead of bonding lines 16 and peripheral edge 18 thereof to form a plurality of rectangles (as in FIG. 7), a different set of bonding lines generally 92 formed diagonally about mattress pad 86 and cooperating with a peripheral edge 94 form the illustrated plurality of geometric shapes 88 and 90.

It is to be further understood that additional variations may be practiced, such as including non-geometric shapes or other designs, repeating or nonrepeating, in a given predetermined pattern formed in a given exemplary embodiment of a mattress pad in accordance with this invention. Similarly, variations in fabric materials, thicknesses, mattress pad sizes, as well as colors of materials (either fabric or foam) may be practiced by those of ordinary skill in the art in the context of the present invention disclosed herewith, and all such variations are intended to come within the broader context of this disclosure invention.

It should be further understood by those of ordinary skill in the art that the foregoing presently preferred embodiments are exemplary only, and that the attendant description thereof is likewise by way of words of example rather than words of limitation, and their use does not preclude inclusion of such modifications, variations, and/or additions to the present invention as would be readily apparent to one of ordinary skill in the art, the scope of the present invention being set forth in the appended claims.

What is claimed is:

1. A washable fabric covered mattress pad, comprising:

a first layer of machine washable air permeable open-celled foam having opposing generally planar sides, said first layer of foam having predetermined length, width, and thickness dimensions selected for use as a mattress pad; and a layer of machine washable air permeable fabric having length and width dimensions corresponding with those of said first layer of foam, and non-removably secured with one generally planar side of said first layer of foam so as to leave the other planar side thereof without fabric adhered thereto.

2. A washable fabric covered mattress pad as in claim 1, wherein said foam comprises resilient polyurethane foam having a thickness generally in a range of from about one inch to about four inches.

3. A washable fabric covered mattress pad as in claim 2, wherein said fabric comprises one of manmade and natural fiber material permanently bonded to said first layer of foam.

4. A washable fabric covered mattress pad as in claim 3, wherein said fabric comprises a nylon material heat bonded to said first layer of foam.

5. A washable fabric covered mattress pad as in claim 1, wherein said mattress pad further comprises a second layer of machine washable foam having opposing generally planar sides, and bonded on one side thereof in a predetermined pattern to said other planar side of said first layer of foam, so as to leave one side of said second layer of foam exposed for non-slip frictional engagement thereof with a mattress on which said mattress pad is used.

6. A washable fabric covered mattress pad as in claim 5, wherein said predetermined pattern comprises a preselected number of rectangles formed over said mattress pad so as to give a quilted appearance thereto.

7. A washable fabric covered mattress pad as in claim 5, wherein said second layer of foam is heat bonded to said first layer of foam along predetermined heat bonding lines forming said predetermined pattern.

8. A washable fabric covered mattress pad as in claim 5, wherein said predetermined pattern comprises preselected geometric shapes forming pockets for air between opposing layers of foam collectively defining individual of such shapes.

9. A washable fabric covered mattress pad as in claim 1, wherein said first layer of foam comprises at least two respective sublayers of foam bonded to one another and having preselected characteristics such that the sublayer secured to said layer of fabric is adapted for flame lamination thereto and such that the other sublayer is a relatively thicker sublayer for resilient support of a user.

10. A fabric covered, completely washable self-positioning mattress pad, comprising:

a first layer of resilient foam material having respective upper and lower support surfaces;

a layer of air permeable fabric permanently bonded to said upper support surface of said first layer of foam; and a second layer of resilient foam material having respective upper and lower support surfaces, said upper support surface of said second layer of resilient foam material being permanently bonded in a predetermined pattern to said lower support surface of said first layer of resilient foam so as to form said predetermined pattern therein and so as to leave exposed said lower support surface of said second layer of resilient foam for frictional self-positioning non-slip engagement thereof with a mattress on which said mattress pad is used, and wherein said first and second layers of resilient foam material each comprise air permeable open-celled material.

11. A mattress pad as in claim 10, wherein the collective thickness of said mattress pad is generally in a range of from about one inch to about four inches, and wherein said mattress pad is strapless.

12. A mattress pad as in claim 10, wherein said layer of fabric comprises a nylon material heat bonded to said upper support surface of said first layer of foam.

13. A fabric covered, completely washable self-positioning mattress pad, comprising:

a first layer of resilient foam material having respective upper and lower support surfaces;

a layer of fabric permanently bonded to said upper support surface of said first layer of foam; and a second layer of resilient foam material having respective upper and lower support surfaces, said upper support surface of said second layer of resilient foam material being permanently bonded in a predetermined pattern to said lower support surface of said first layer of resilient foam so as to form said predetermined pattern therein and so as to leave exposed said lower support surface of said second layer of resilient foam for frictional self-positioning non-slip engagement thereof with a mattress on which said mattress pad is used; and wherein said first layer of foam is comprised of at least two respective sublayers of foam having preselected characteristics and bonded to one another; and further wherein said predetermined pattern comprises preselected geometric shapes.

14. A mattress pad as in claim 11, wherein said predetermined pattern comprises a plurality of relatively large rectangular shapes such as to give a quilted surface appearance to said layers of fabric.

15. A mattress pad as in claim 11, wherein said layer of fabric comprises one of manmade or natural fiber material flame laminated to said first layer of resilient foam.

16. A mattress pad as in claim 11, wherein said first and second layers of foam are respectively heat bonded along heat bonding lines forming said predetermined pattern therein.

17. A fabric covered, completely washable self-positioning mattress pad, comprising:

a first layer of resilient foam material having respective upper and lower support surfaces;

a layer of fabric permanently bonded to said upper support surface of said first layer of foam; and a second layer of resilient foam material having respective upper and lower support surfaces, said upper support surface of said second layer of resilient foam material being permanently bonded in a predetermined pattern to said lower support surface of said first layer of resilient foam so as to form said predetermined pattern therein and so as to leave exposed said lower support surface of said second layer of resilient foam for frictional self-positioning non-slip engagement thereof with a mattress on which said mattress pad is used; and wherein said predetermined pattern varies over the surface of said mattress pad.

* * * * *